US006813955B2

(12) United States Patent
McKelvey et al.

(10) Patent No.: US 6,813,955 B2
(45) Date of Patent: Nov. 9, 2004

(54) INFLATABLE TENSIONING DEVICE

(76) Inventors: John Paul McKelvey, 7 Fort Street, Illovo, Johannesburg, Gauteng (ZA), 2196; David Charles Tyrer, 121 Mowbray Road, Greenside, Johannesburg, Gauteng (ZA), 2193

( * ) Notice: Subject to any disclaimer, the term of this patent is extended or adjusted under 35 U.S.C. 154(b) by 0 days.

(21) Appl. No.: 10/344,027

(22) PCT Filed: Aug. 27, 2001

(86) PCT No.: PCT/ZA01/00124

§ 371 (c)(1),
(2), (4) Date: Feb. 6, 2003

(87) PCT Pub. No.: WO02/18103

PCT Pub. Date: Mar. 7, 2002

(65) Prior Publication Data

US 2004/0035212 A1 Feb. 26, 2004

(51) Int. Cl.[7] ..... G01L 7/02
(52) U.S. Cl. ..... 73/730; 73/700; 73/756
(58) Field of Search ..... 73/700–756

(56) References Cited

U.S. PATENT DOCUMENTS 4,023,415 A * 5/1977 Garcia ..... 73/729.1
4,295,635 A 10/1981 Pustka et al.
4,485,677 A 12/1984 Amelot et al.
5,033,505 A * 7/1991 Eidsmore ..... 137/505.39
5,638,868 A * 6/1997 Loran ..... 138/31

FOREIGN PATENT DOCUMENTS

| | | | |
|---|---|---|---|
| EP | 0 468 851 | 1/1992 | |
| JP | 61268017 A | * 11/1986 | ..... H01L/21/205 |
| JP | 02132276 A | * 5/1990 | ..... E04G/23/02 |

* cited by examiner

*Primary Examiner*—Edward Lefkowitz
*Assistant Examiner*—Jermaine Jenkins
(74) *Attorney, Agent, or Firm*—Keusey, Tutunjian & Bitetto, P.C.

(57) ABSTRACT

There is provided a tensioning device that includes an inflatable pressure vessel, a bellows arrangement, and a valve. The pressure vessel has two superimposed major wall components fabricated from sheet metal and further has an aperture which passes through the two superimposed major wall components. The aperture has an axial direction. The bellows arrangement is connected to and located between the two superimposed major wall components at and around the aperture. The valve is for filling the pressure vessel with liquid under pressure to cause the pressure vessel to be inflated in the axial direction of the aperture.

20 Claims, 3 Drawing Sheets

INFLATABLE TENSIONING DEVICE

FIELD OF THE INVENTION

This invention relates to a device for tensioning elongated elements such as wire ropes, chains, bolts, rods or the like. In particular it is intended for use in the construction or mining industry for tensioning mechanical anchors, reinforcing rods and so on which are used to stabilize and support the walls of rock or ground excavations.

BACKGROUND TO THE INVENTION

Mechanical rock anchors, concrete reinforcing cables and the like are typically tensioned, once anchored, by means of a removable hydraulic cylinder jack which is heavy and cumbersome to operate and manoeuvre in underground workings and particularly in the confined work space in many mine workings.

SUMMARY OF THE INVENTION

A tensioning device according to the invention comprises an inflatable pressure vessel having two superimposed major wall components characterised in that the vessel includes an aperture which passes through both major wall components and a valve for filling the vessel with liquid under pressure to cause the vessel to be inflated in the axial direction of the aperture. The pressure vessel is conveniently made from sheet metal.

The major wall components may be sealingly connected about their outer peripheries and on the periphery of the aperture. The pressure vessel and its aperture are preferably circular about the axis of the aperture.

The tensioning device may include a bellows arrangement which is connected to and located between the two major wall components of the pressure vessel around the aperture. The device may additionally include a second bellows arrangement which is connected to and located between the outer peripheries of the two major wall components of the pressure vessel.

In another form of the invention the pressure vessel includes an upstanding peripheral wall and one of the major wall components of the vessel is inwardly dished from the upper end of the wall towards the outer major wall component. Conveniently the upper end of the wall of the vessel is substantially rounded.

In certain applications the tensioning device may include a pressure indicating device which is open to the cavity of the pressure vessel.

A method of tensioning an elongated member such as a metal rod, rope or the like by means of the above tensioning device characterised in that according to the invention the method includes the steps of anchoring the elongated member in a body, passing one end of the member through the aperture of the tensioning device on the outside of the body of material, bringing a first major wall component of the device to bear on a surface of the body, locating a pressure plate over the elongated member and against the second major wall component of the tensioning device, locking the pressure plate against the tensioning device by means engaged with the elongated member and inflating the tensioning device pressure vessel by means of liquid under pressure to cause its two major wall components to move away from each other to tension the elongated member between its anchor in the body and the pressure plate.

BRIEF DESCRIPTION OF THE DRAWINGS

A number of embodiments of the tensioning device of the invention are now described by way of example only with reference to the drawings in which.

DETAILED DESCRIPTION OF THE ILLUSTRATED EMBODIMENTS

Figure 1:
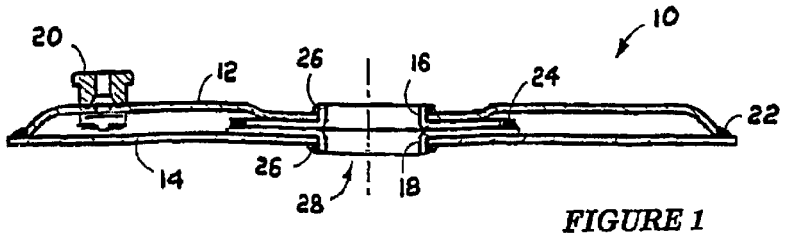
FIG. 1 is a sectioned side elevation of one embodiment of the tensioning device of the invention.
Figure 2:
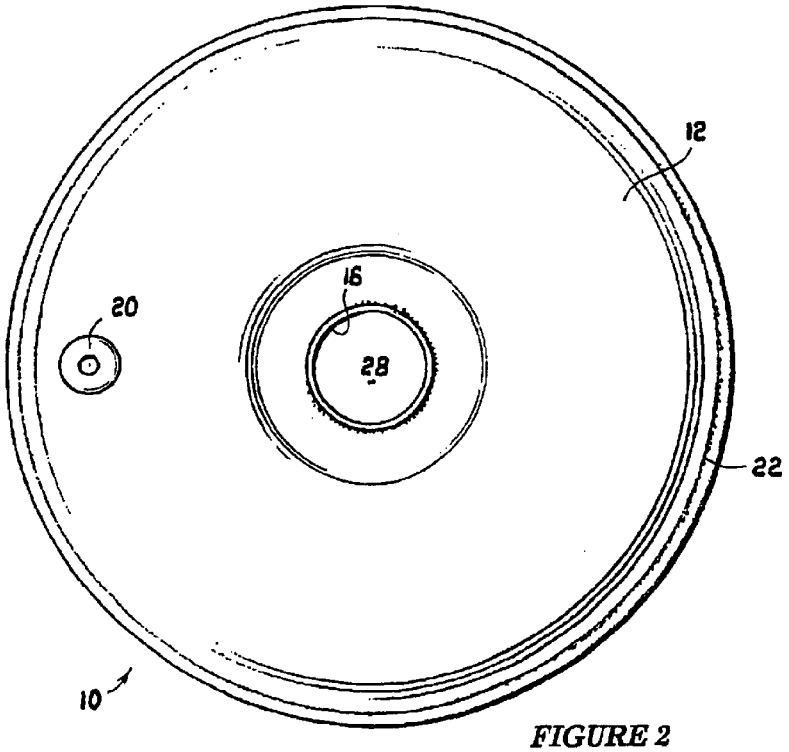
FIG. 2 is a plan view of the FIG. 1 tensioning device.
Figure 3:
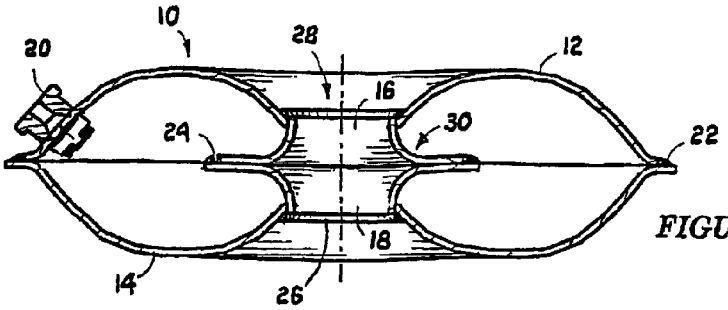
FIG. 3 is a sectioned side elevation of the device of FIGS. 1 and 2 shown in its inflated condition.

The tensioning device 10 of FIGS. 1 to 3 is shown in the drawings to include major wall components 12 and 14, radially flanged bosses 16 and 18 and a one-way filler valve 20.

Other than the valve 20 the remaining components of the tensioning device are made from sheet metal such as 2 mm or 3 mm mild steel. As is shown in FIG. 2, the device 10 is circular in plan.

The outer peripheral edges of the wall components 12 and 14 and the radial flanges of the bosses 16 and 18 are peripherally seam welded together at 22 and 24 respectively. The bosses 16 and 18 are located in circular apertures in the wall components 12 and 14 and are welded to the wall components at 26 to provide a closed pressure vessel having a central aperture 28 through the bosses 16 and 18.

The valve 20 is a one-way valve which is located in and passes through the wall component 12 and through which, in use, a liquid such as water or a suitable mineral oil is fed under high pressure into the pressure vessel to expand the vessel, as shown in FIG. 3, in the axial direction of the aperture 28. As is seen from FIG. 3 the radial boss flanges are moved apart towards the aperture 28 as the vessel is inflated to serve as a bellows-like arrangement 30 to permit a greater than otherwise possible separation or stroke distance of the wall components 12 and 14 when the pressure vessel is fully inflated as shown in FIG. 3.

Figure 4:
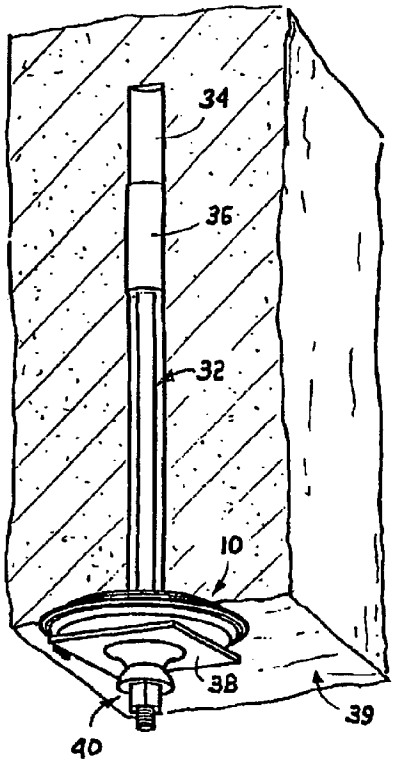
FIG. 4 is a perspective view from below of the device of FIGS. 1 to 3 in use.

In use the tensioning device 10 could be used to tension almost any elongated article such as a rod, cable or the like which has a cross-sectional dimension which will permit its passage through the aperture 28. FIG. 4 illustrates the use of the device in 10 in tensioning a rock bolt 32.

The FIG. 4 rock bolt is conventional and includes a tendon rod which carries, towards the distal end of a hole 34 a radially expansible mechanical anchor 36 with its proximal end being threaded and projecting from the hole 34. The rock bolt is locked by the anchor head 36 in any conventional manner and when locked the tensioning device 10 is located over the projecting end of the rock bolt tendon with its valve 20 facing downwardly and its under side, in FIG. 1, against the rock face 39. A pressure plate which could be in the form of a normal face washer 38 is located over the tendon rod and pressed up against the underside of the device 10. A conventional domed washer and nut arrangement is then engaged with the free end of the tendon and pulled up lightly against the pressure plate 38. A high pressure water hose is then connected to the valve 20 and the tensioning device is filled with water to a pressure of about 8 mpa to inflate the pressure vessel of the device 10 to the configuration illustrated in FIG. 3 where the device 10 has moved the pressure plate away from the rock face against which it bears by the stroke distance of the device 10 to tension the anchor bolt tendon in the hole 34.

Figure 5:
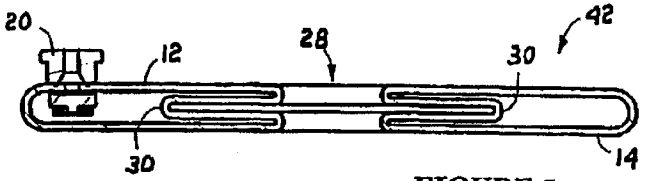
FIG. 5 is a sectioned side elevation of a second embodiment of the tensioning device of the invention.
Figure 6:
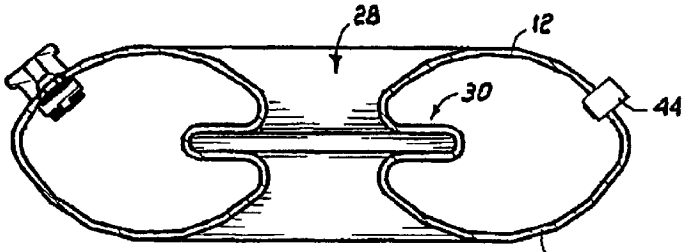
FIG. 6 is a sectioned side elevation of the device of FIG. 5 shown inflated.

In the embodiment 42 of the tensioning device of the invention which is illustrated in FIGS. 5 and 6 like reference numbers to those of the device 10 of FIGS. 1 to 3 denote like components. The major difference between the FIG. 1 and FIG. 5 embodiments of the tensioning device of the invention is that the device of FIG. 5 does not include the separate bosses 16 and 18 of FIG. 1 and the bellows expansion arrangement 30 is provided by radially outward folds from the aperture 28 as illustrated in FIGS. 5 and 6. In applications where it is required that the tension force be relieved to enable whatever is tensioned by the device, such as the rock bolt 32 in FIG. 4, to yield in length under load, a pressure relief valve 44 could be located in and through the wall of the pressure vessel as illustrated in FIG. 6.

Figure 7:
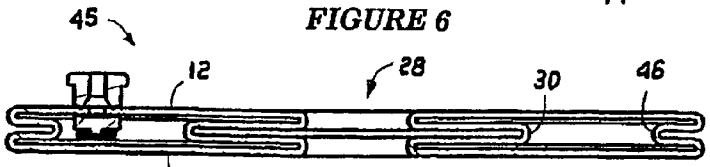
FIGS. 7 and 8 are sectioned side elevations of a third embodiment of the tensioning device of the invention shown respectively to be deflated and inflated.
Figure 8:
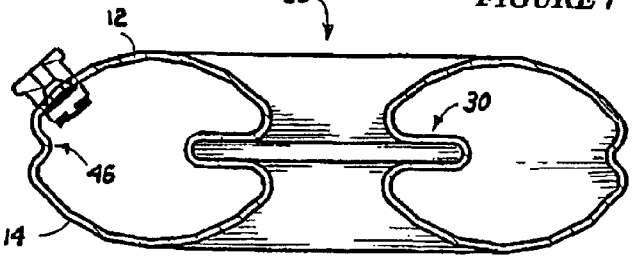

The tensioning device 45 of FIGS. 7 and 8 is much the same as that of FIGS. 5 and 6 except for the bellows-like fold 46 between the wall components 12 and 14 at the outer periphery of the device. The purpose of this arrangement is to provide an increase in the stroke distance over that which the device of FIGS. 5 and 6 is capable of.

Figure 9:
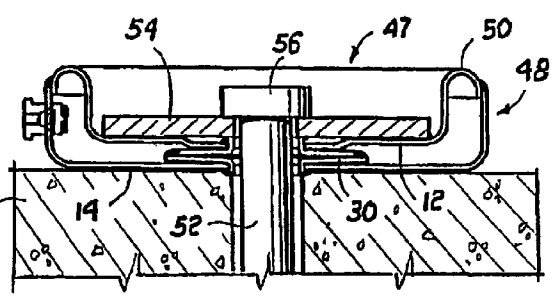
FIGS. 9 and 10 are again respectively deflated and inflated sectioned side elevations of a fourth embodiment of the tensioning device of the invention in use.
Figure 10:
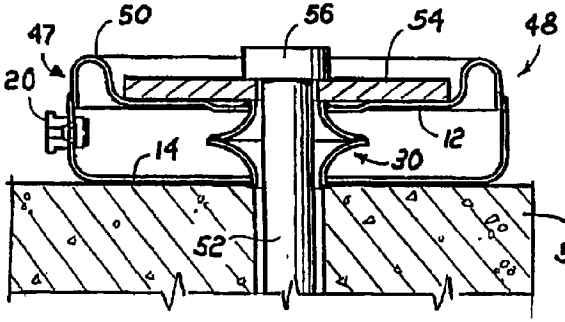

The tensioning device 47 of FIGS. 9 and 10 is much the same as that of FIGS. 1 to 3 with the exception of its upstanding peripheral wall 48.

As is seen in FIGS. 9 and 10 the wall component 12 is, in this embodiment of the invention, welded to the upstanding periphery of the component 14 with the component 12 being inwardly dished to provide the wall 48 with a rounded upper end 50. In use, in tensioning a rod 52 or whatever else is to be tensioned by the device, the device is located over the rod with a pressure plate 54 located between the flat dished portion of the wall component 12 and a head 56 on the rod 52. The rod 52 is anchored in a body of material 58 and the device is inflated from the configuration shown in FIG. 9 to that of FIG. 10 by means of a liquid under pressure. As the device is inflated the flat portion of the dished wall 12 bears up against the under side of the pressure plate 54 which is lifted to the position shown in FIG. 10 as the upper end 50 of the wall 48 of the device is smoothly unrolled. The main feature of this embodiment of the tensioning device of the invention over those previously described is that the device is capable of a longer stroke than is possible than with the other devices and tensions whatever it is used to tension with a more linear application of the load than the previous embodiments of the invention are capable of.

Figure 11:
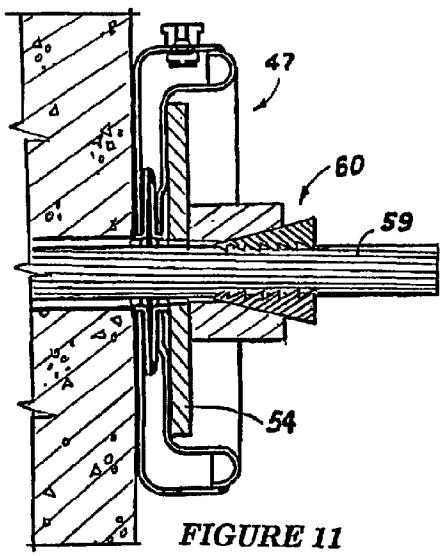
FIG. 11 is the same view as that of FIG. 9 showing the tensioning device in use in cable tensioning.

FIG. 11 shows a cable 59 which is to be tensioned by the device of FIG. 9 with the cable being locked indirectly to the pressure plate 54 by a conventional taper wedge lock arrangement 60 in place of the head 56 on the rod 52.

Figure 12:
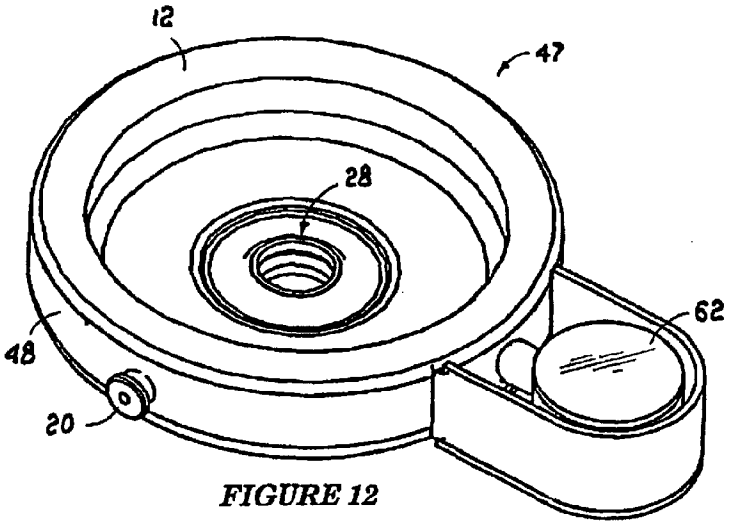
FIG. 12 is a perspective view from above of the tensioning device of FIGS. 9 to 11 including a pressure indicator.

FIG. 12 is again the tensioning device of FIGS. 9 and 10 but in this embodiment of the invention includes a pressure gauge 62 by means of which the tension on whatever is being tensioned by the device may be monitored by the gauge 62 being open to the liquid pressure in the pressure vessel of the device.

The pressure gauge 62 could be replaced by a simpler but less accurate pressure monitoring device which could consist of a short cylinder which is mounted through the wall of the pressure vessel in much the same manner as the valve 20 with the cylinder carrying a piston and piston rod with the piston being biased towards the interior of the pressure vessel by means of a suitable spring or the like and the piston rod projecting sealingly from an opening in the end wall of the cylinder with the piston rod carrying graduations indicating the liquid pressure acting on the piston in the cylinder.

The invention is not limited to the precise details as herein described. For example, in its simplest, less effective form, the tensioning device of the invention could be that of FIG. 1 excluding the expansible bellows-like arrangement 30. In its stead the major wall components 12 and 14 could merely be welded together about the aperture 28. Additionally, the position of welds shown in the drawings are not to be taken to be in any way limiting to the invention as these may conventionally be located at other positions on the device.

What is claimed is:

1. A tensioning device, comprising:

an inflatable pressure vessel having two superimposed major wall components fabricated from sheet metal and further having an aperture which passes through the two superimposed major wall components, the aperture having an axial direction;

a bellows arrangement which is connected to and located between the two superimposed major wall components at and around the aperture; and a valve for filling the pressure vessel with liquid under pressure to cause the pressure vessel to be inflated in the axial direction of the aperture.

2. The tensioning device as claimed in claim 1, wherein the two superimposed major wall components have outer peripheries and the aperture has a periphery, and the two superimposed major wall components are sealingly connected about the outer peripheries and on the periphery of the aperture to the bellows arrangement.

3. The tensioning device as claimed in claim 1, wherein the pressure vessel and the aperture are circular about the axial direction of the aperture.

4. The tensioning device as claimed in claim 3, wherein another bellows arrangement is connected to and located between the outer peripheries of the two superimposed major wall components of the pressure vessel.

5. The tensioning device as claimed in claim 1, wherein the pressure vessel includes an upstanding peripheral wall having an upper end, and one of the two superimposed major wall components of the pressure vessel is inwardly dished away from the upper end of the upstanding peripheral wall.

6. The tensioning device as claimed in claim 5, wherein the upper end of the upstanding peripheral wall of the pressure vessel is substantially rounded.

7. The tensioning device as claimed in claim 1, wherein the pressure vessel comprises a cavity, and the tensioning device further comprises a pressure indicating device which is open to the cavity of the pressure vessel.

8. The tensioning device as claimed in claim 1, wherein the pressure vessel has a central portion, and the aperture is disposed at the central portion.

9. The tensioning device as claimed in claim 1, wherein the bellows arrangement comprises two radially flanged bosses.

10. The tensioning device as claimed in claim 1, wherein the bellows arrangement comprises folds that are radially disposed with respect to the aperture.

11. The tensioning device as claimed in claim 10, wherein the tensioning device has an outer periphery, and the bellows arrangement further comprises additional folds disposed at the outer periphery of the tensioning device to provide an increase in stroke with respect to the folds that are radially disposed with respect to the aperture.

12. The tensioning device as claimed in claim 1, wherein the pressure vessel comprises a cavity, and the tensioning device further comprises a pressure indicating device that is open to the cavity of the pressure vessel.

13. A method of tensioning an elongated member using a tensioning device, the method comprising the steps of:

providing a tensioning device having an inflatable pressure vessel comprised therein, the pressure vessel having two major wall components, an aperture which passes through each of the two major wall components, and a bellows arrangement connected to and located between the two major wail components at and around the aperture;

anchoring the elongated member in a body of material;

passing an end of the elongated member through the aperture on the outside of the body of material;

bringing one of the two major wall components to bear on a surface of the body of material;

locating a pressure plate over the elongated member and against another one of the two major wall components;

locking the pressure plate against the tensioning device by engaging means engaged with the elongated member; and filling the pressure vessel with a pressurized liquid to expand the bellows arrangement such that the two major wall components move away from each other to tension the elongated member between an anchor point in the body of material and the pressure plate.

14. A tensioning device, comprising:

an inflatable pressure vessel having a first sheet metal wall and a second sheet metal wall that is coupled to the first sheet metal wall, and further having an aperture centrally disposed through the first sheet metal wall and the second sheet metal wall, the first and the second sheet metal wall having a longitudinal axis, the aperture having an axial direction that transverse with respect to the longitudinal axis of the first and the second sheet metal wall;

a bellows arrangement disposed between the first and the second sheet metal wall; and a valve for filling the pressure vessel with pressurized liquid to expand the bellows arrangement and inflate the pressure vessel in the axial direction of the aperture.

15. The tensioning device as claimed in claim 14, wherein the pressure vessel has a central portion, and the aperture is disposed at the central portion.

16. The tensioning device as claimed in claim 14, wherein the bellows arrangement comprises two radially flanged bosses.

17. The tensioning device as claimed in claim 14, wherein the bellows arrangement comprises folds that are radially disposed with respect to the aperture.

18. The tensioning device as claimed in claim 17, wherein the tensioning device has an outer periphery, and the bellows arrangement further comprises additional folds disposed at the outer periphery of the tensioning device to provide an increase in stroke with respect to the folds that are radially disposed with respect to the aperture.

19. The tensioning device as claimed in claim 14, wherein the pressure vessel includes an upstanding peripheral wall having an upper end, and the first sheet metal wall is inwardly dished away from the upper end of the upstanding peripheral wall.

20. The tensioning device as claimed in claim 19, wherein the upper end of the upstanding peripheral wall of the pressure vessel is substantially rounded.

* * * * *